United States Patent [19]

Margraf

[11] Patent Number: 4,593,515

[45] Date of Patent: Jun. 10, 1986

[54] DROPPED-ARTICLE SENSOR AND WRAPPING MACHINE INTERRUPT

[75] Inventor: Dallas A. Margraf, Spring Valley, Ohio

[73] Assignee: Hobart Corporation, Troy, Ohio

[21] Appl. No.: 712,939

[22] Filed: Mar. 18, 1985

[51] Int. Cl.[4] ..... B65B 57/16

[52] U.S. Cl. ..... 53/56; 53/502

[58] Field of Search ..... 53/56, 55, 502, 494, 53/556, 493, 506, 73, 74, 77, 507, 508

[56] References Cited

U.S. PATENT DOCUMENTS

| | | | |
|---|---|---|---|
| 2,325,455 | 7/1943 | Williams | 53/56 X |
| 2,578,799 | 12/1951 | Grey | 53/56 X |
| 4,274,499 | 6/1981 | Grimminger et al. | 53/502 X |
| 4,383,795 | 5/1983 | Wakamatsu et al. | 53/494 X |
| 4,415,048 | 11/1983 | Teraoka | 53/502 X |
| 4,458,470 | 7/1984 | Fine | 53/502 |

*Primary Examiner*—James F. Coan

*Attorney, Agent, or Firm*—Biebel, French & Nauman

[57] ABSTRACT

A dropped-article sensor is positioned beneath the platform conveyor of a wrapping machine wherein articles are received at a feed-in station and conveyed to a wrapping station along a conveyor path extending between and including the feed-in station and the wrapping station with sheets of wrapping material being wrapped about the packages at the wrapping station. Articles dropped from the conveyor path fall upon the dropped-article sensor which not only catches the articles, but generates a wrapping machine stop signal or interrupt such that the dropped article must be retrieved before restarting the wrapping machine.

20 Claims, 7 Drawing Figures

DROPPED-ARTICLE SENSOR AND WRAPPING MACHINE INTERRUPT

BACKGROUND OF THE INVENTION

The present invention relates generally to package wrapping machines wherein packages to be wrapped are carried along a conveyor path extending between and including a feed-in station and a wrapping station and, more particularly, to a dropped-article sensor for catching an article dropped from the conveyor path and for generating a wrapping machine interrupt signal in response thereto.

A large variety of package wrapping machines are known in the prior art. One category of wrapping machine which is presently very popular in the supermarket industry includes a package elevator. In such machines, packages such as trayed meat, produce or other food products are initially placed at a feed-in station, conveyed from the feed-in station to a wrapping station including the elevator which then raises the packages into sheets of wrapping material. The sheets of wrapping material are then folded about the packages and secured therebeneath to attractively display the meat, produce or other food products. An illustrative package elevating wrapping machine which utilizes film wrapping material is disclosed in U.S. Pat. No. 4,501,106, issued to Fritz F. Treiber et al. on Feb. 26, 1985, and entitled "Wrapping Control System for Film Wrapping Machine," which patent is assigned to the assignee of the present application and is incorporated herein by reference. While the present invention is applicable to any wrapping machine wherein packages to be wrapped are conveyed from a feed-in station to a wrapping station, the dropped-article sensor of the present invention is particularly applicable to elevating wrapping machines and, hence, will be described herein with reference to such machines. The term "article" as used herein should be interpreted as referring to a package or a part or portion of a product making up a package. Two solutions to the problem of dropped articles have been utilized in known package elevating wrapping machines. In the first solution, a chute or slide is positioned adjacent to and inclined away from the elevator to catch and direct dropped articles toward the operator end of the machine. An operator may then open the machine to retrieve a dropped article and possibly salvage the article.

In the interest of saving space, package wrapping machines are preferably compact and include relatively dense construction of mechanical apparatus to perform the wrapping. See, for example, the above-referenced U.S. Pat. No. 4,501,106. Accordingly, articles which are inadvertently dropped to the article catching slide, particularly in the case of larger sized articles, may interfere with or be engaged by operating mechanisms within the wrapping machine. For example, in the wrapping machine of the above-referenced patent application, a package pusher is continuously circulated in close proximity to the article catching slide. If a dropped article remains on the slide, the package pusher may engage and jam the article, potentially damaging or jamming the machine and/or destroying the article.

In accordance with the second solution to the problem, a dropped-article catcher pan is coupled to an elevator of a package elevating wrapping machine to follow the reciprocating movement of the elevator and, hence, be ever-present and available for catching a dropped article. Such a dropped-article catcher pan is disclosed in U.S. patent application Ser. No. 578,146, filed by Glenn R. Stockmeier et al. on Feb. 8, 1984, and entitled "Dropped-Package Catcher," which application is assigned to the assignee of the present application and is incorporated herein by reference.

The dropped-article catcher pan overcomes the problem of the prior art chute or slide by catching one or a limited number of articles in the pan. However, problems may be encountered if operators of the wrapping machine fail to clean out the article catcher pan as articles are dropped. Oftentimes, the operators may be unaware that an article has fallen from the conveyor path. If the pan is not cleared each time one or a small number of articles are dropped, one or more articles remain in the tray and may soil the tray and lead to an unsanitary condition. Further, after a limited number of articles have been accumulated in the catcher pan, the next article to be dropped may lead to a machine jam requiring service personnel to restore the machine to operation. In addition, the dropped-article catcher pan as well as the preceding dropped-article chute or slide are difficult to clean or are "overlooked" by the machine operator, hence, leading to unsanitary surfaces. When an article falls on such an unsanitary surface, the article becomes contaminated and must be thrown away. If the articles are meat, it is obvious that monetary losses can be large.

It is, thus, apparent that the need exists for improved apparatus for sensing articles which are dropped from a conveyor path of a package wrapping machine to prevent potential destruction or contamination of the dropped articles as well as damage to or jamming of the wrapping machine itself.

SUMMARY OF THE INVENTION

In accordance with the present invention, the problems associated with the prior art arrangements for handling dropped articles in package wrapping machines are overcome by an improvement comprising dropped-article sensing means. The sensing means are positioned beneath conveyor means in a wrapping machine wherein articles to be packaged are received at a feed-in station and conveyed to a wrapping station along a conveyor path extending between and including the feed-in station and the wrapping station with sheets of wrapping material being wrapped about the packages at the wrapping station. The dropped-article sensing means catches articles dropped from the conveyor path and generates a wrapping machine stop signal or interrupt in response to a dropped article whereby the dropped article must be retrieved before restarting the wrapping machine and the dropped article may be salvaged. Since the machine is stopped by a dropped article engaging the dropped-article sensing means, the article must be retrieved by the operator of the machine before the machine may be restarted.

Dropped articles are caught by the dropped-article sensing means which is easily accessible beneath the conveyor means. Accordingly, the operator of the package wrapping machine can conveniently maintain the dropped-article sensing means in a sanitary condition such that articles may be salvaged for packaging by the wrapping machine. It is noted that the operator is reminded to clean the dropped-article sensing means each time the machine is stopped by an article being dropped thereon.

In accordance with one embodiment of the present invention, the dropped-article sensing means comprises a generally horizontal sensing member which is mounted for movement between a first raised position and a second lowered position. Resilient means, preferably such as one or more springs, is connected to the sensing member for biasing it to the first raised position. Finally, switch means are coupled to the sensing member for generating the wrapping machine stop signal or interrupt in response to movement of the sensing member from the first raised position toward the second lowered position in opposition to the resilient means and in response to catching a dropped article. The generally horizontal sensing member may comprise a plate which is preferably pivotally mounted at one end.

In the preferred embodiment of the present invention, dropped-article sensing means further comprises a fixedly mounted horizontal plate having a plurality of slots formed therethrough. In this embodiment, the horizontal sensing member comprises a grillwork including a plurality of parallel bars equal in number to the number of the slots in the horizontal plate and positioned to pass longitudinally therethrough. While the grillwork may be mounted in a variety of ways for resiliently biased vertical movement through the slots, preferably, the grillwork is pivotally mounted at one end. The dropped-article sensing means of this embodiment further comprises an opening through the horizontal plate positioned toward the feed-in station to facilitate cleaning and the maintenance of its article catching surface in a sanitary state whereby articles dropped thereon may be salvaged.

It is desirable to set the sensing means as sensitive as possible such that the smallest or lightest possible articles dropped from the article conveyor path can be sensed. The illustrated embodiments must be set to a minimum weight of approximately 0.25 pound.

It is apparent that the dropped-article sensing means of the present invention can be weight-triggered by a sufficiently heavy article being dropped thereon. Further, in the illustrated embodiments, the dropped-article sensing means can be interference-triggered for articles of insufficient weight. For the illustrated wrapping machine, the conveyor means comprises a number of platforms which pass in close proximity to the upper surface of the dropped-article sensing means. If an article too small to weight trigger the dropped-article sensing means falls thereon, the sensing means can be activated when one of the succeeding platforms passes over the dropped article and forces it into the sensing means. Accordingly, the dropped-article sensing means of the present invention can be both weight-activated and interference-activated.

It is, therefore, an object of the present invention to provide an improved dropped-article sensor positioned beneath a conveyor extending between a feed-in station and a wrapping station of a package wrapping machine for catching articles dropped from a conveyor path extending between and including the feed-in station and the wrapping station and for generating a wrapping machine stop signal or interrupt in response to sensing a dropped article whereby the dropped article must be retrieved before restarting the wrapping machine and may be salvaged.

It is another object of the present invention to provide an improved dropped-article sensor positioned beneath and in close proximity to a conveyor extending between a feed-in station and a wrapping station such that the article sensor is weight-triggered by a sufficiently heavy dropped article or interference-triggered by an insufficiently heavy dropped article being trapped between the conveyor and the article sensor.

Other objects and advantages of the invention will be apparent from he following description, the accompanying drawings and the appended claims.

DETAILED DESCRIPTION OF THE INVENTION

Overall operation of a package elevating wrapping machine is fully described in the above-referenced U.S. Pat. No. 4,501,106. Accordingly, only the operation of a limited portion of such a wrapping machine relating to package feed-in and conveyance to the elevator will be described herein to facilitate description of the dropped-article sensor and wrapping machine interrupt in accordance with the present invention.

Figure 1:
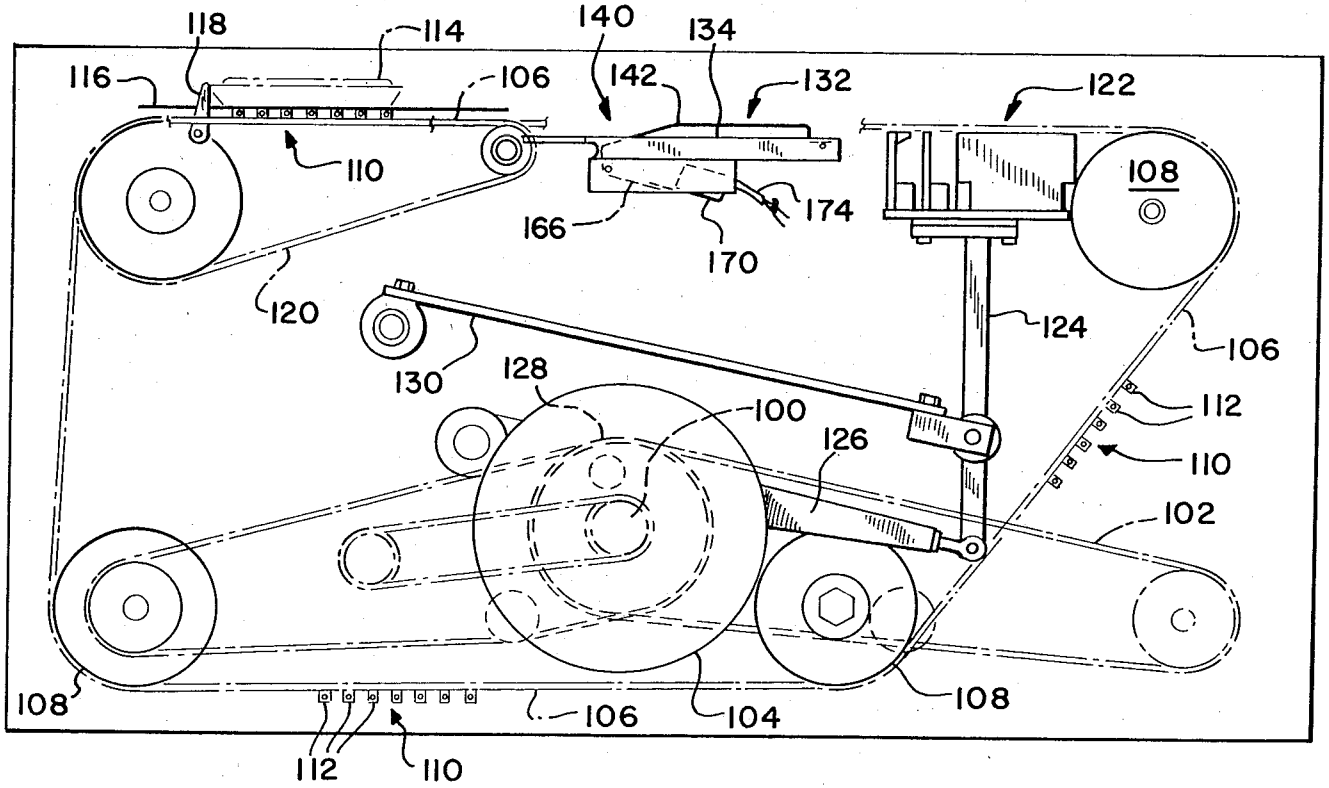
FIG. 1 is a diagrammatical vertical crosssection taken generally along the longitudinal center line of a package elevating wrapping machine illustrating the dropped-article sensor in accordance with the present invention.

As shown in FIG. 1, a main drive shaft 100 is driven by an electric motor (not shown) and a gear reduction drive (not shown) through a chain 102. The main drive shaft 100 drives an elevator cam 104 and also drives chains 106 around sprockets 108. Supported on the chains 106 are three circulating platforms 110 which are comprised of cylindrical shafts or rods 112 mounted to the conveyor chains 106.

A package 114 to be wrapped, typically comprising meat, produce or other food products, is placed upon a shallow tray such that a transparent film can be wrapped about the package to protect the contents of the tray and yet form a package which attractively displays the contents. The package 114 is placed on a package feed-in tray 116 which defines the package feed-in station of the wrapping machine. A package feed-in pusher 118 which is connected to and circulated on conveyor chains 120 advances the package 114 into the wrapping machine. As the package 114 is advanced beyond the end of the package feed-in tray 116, it is supported and carried forward by one of the three circulating platforms 110.

The package 114 is carried on one of the platforms 110 to an elevator 122 which, in turn, elevates the package 114 into a sheet of wrapping material as is fully disclosed in the above-referenced U.S. Pat. No. 4,501,106. The elevator 122 comprises a portion of and identifies the wrapping station of the wrapping machine. The elevator 122 is supported on a shaft 124 which is reciprocated in a vertical direction by a pivotally mounted elevator control arm 126 by means of the elevator cam 104 which engages a cam follower 128 connected to the control arm 126. A pivotally mounted stabilizing arm 130 is connected to the shaft 124 to maintain the shaft 124 in a vertical orientation throughout its reciprocating motions. It is apparent that packages wrapped by the machine travel along a conveyor path extending between and including the feed-in station and the wrapping station.

FIGS. 1–5 show a preferred embodiment of the dropped-article sensor and wrapping machine interrupt apparatus in accordance with the present invention. In the preferred embodiment, dropped-article sensing means 132 is positioned beneath conveyor means formed by the platforms 110 circulating on the chains 106 and between the feed-in station defined by the feed-in tray 116 and the wrapping station defined by the elevator 122. The dropped-article sensing means 132 catches articles dropped from the conveyor path extending between and including the feed-in station and the wrapping station, and generates a wrapping machine stop signal or interrupt in response to dropped articles falling onto the sensing means 132. A machine stop signal or interrupt is also triggered by interference if an article is wedged between a platform 110 and the sensing means 132, but is otherwise of insufficient weight to activate the dropped-article sensing means 132.

Figure 2:
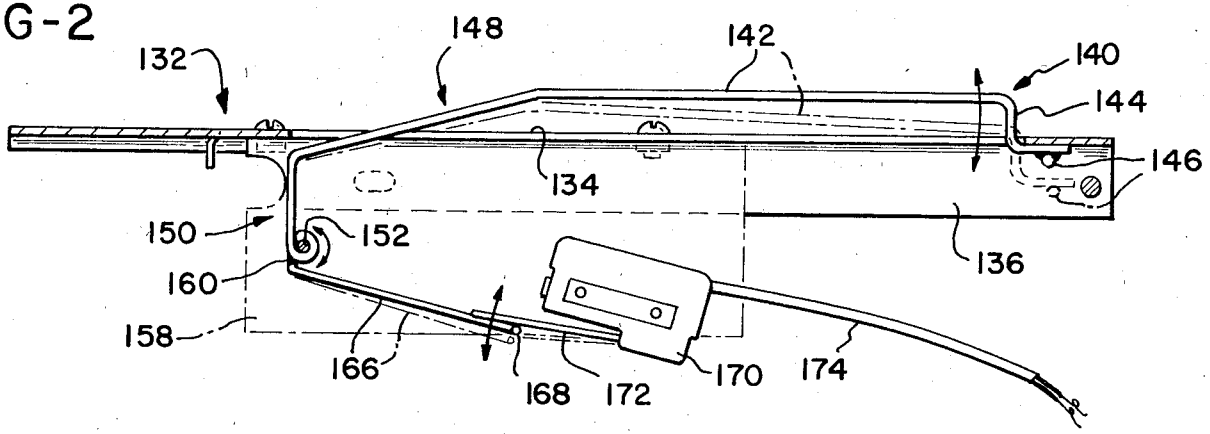
FIGS. 2–4 show the front, top and back views, respectively, of the dropped-article sensor shown in FIG. 1 on an enlarged scale.
Figure 4:
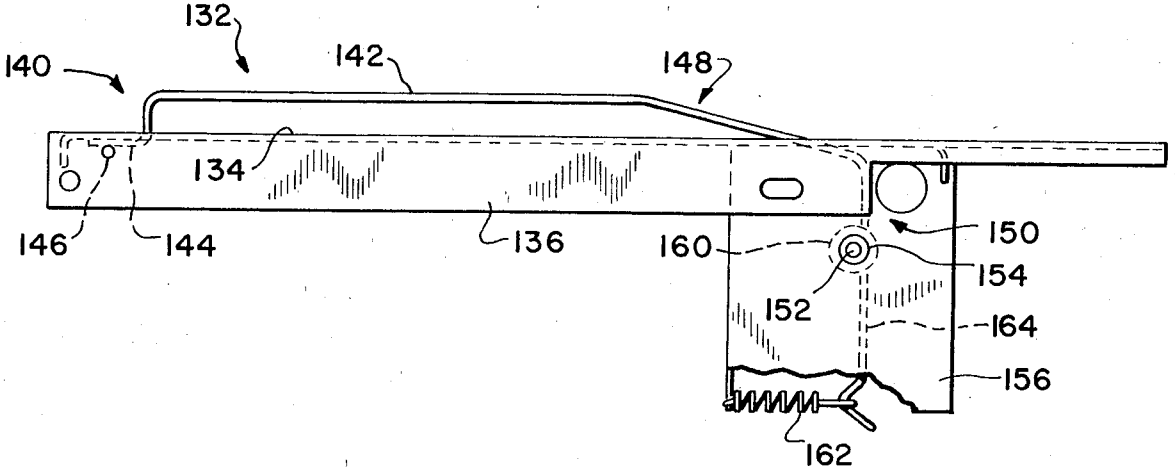
Figure 3:
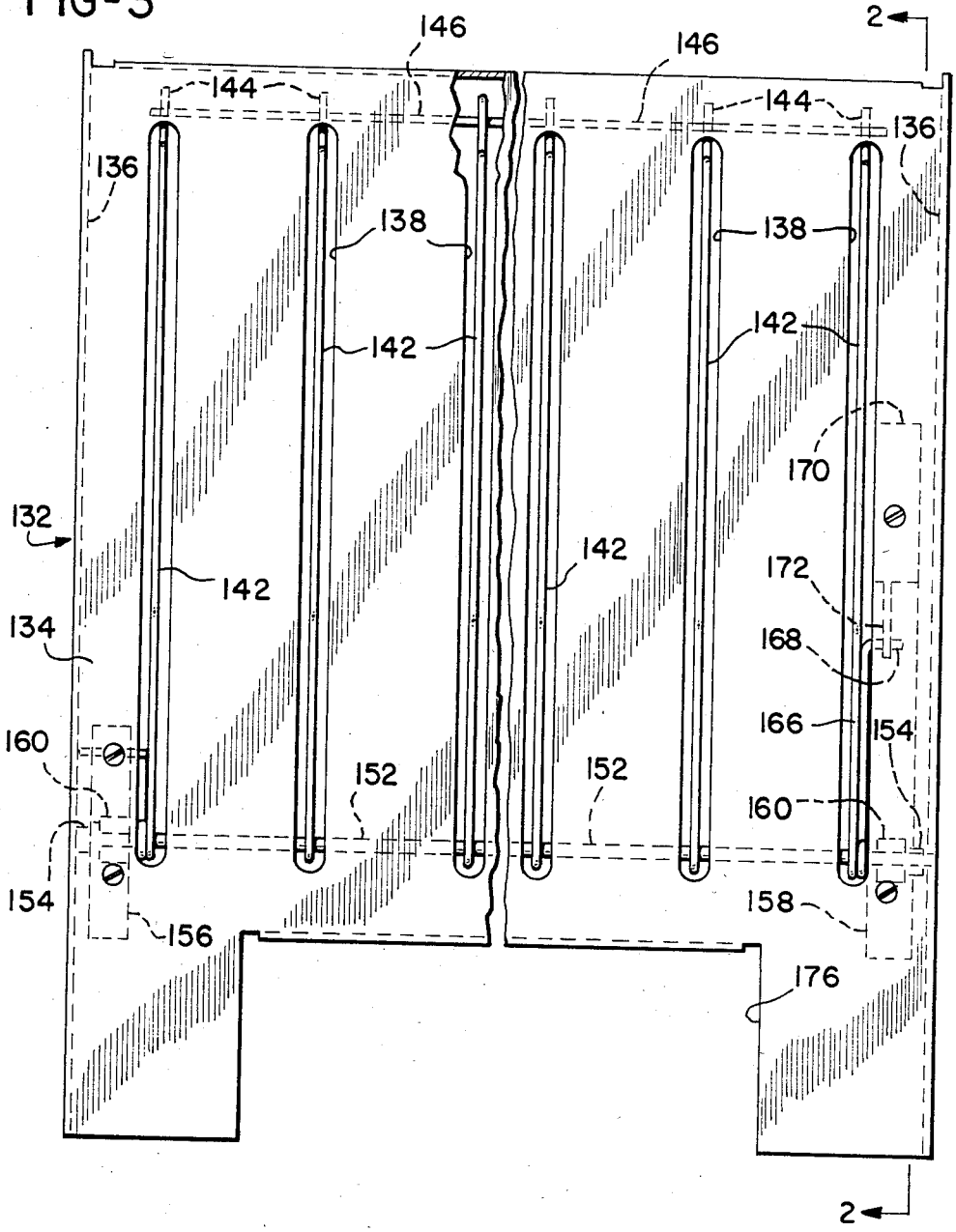
Figure 5:
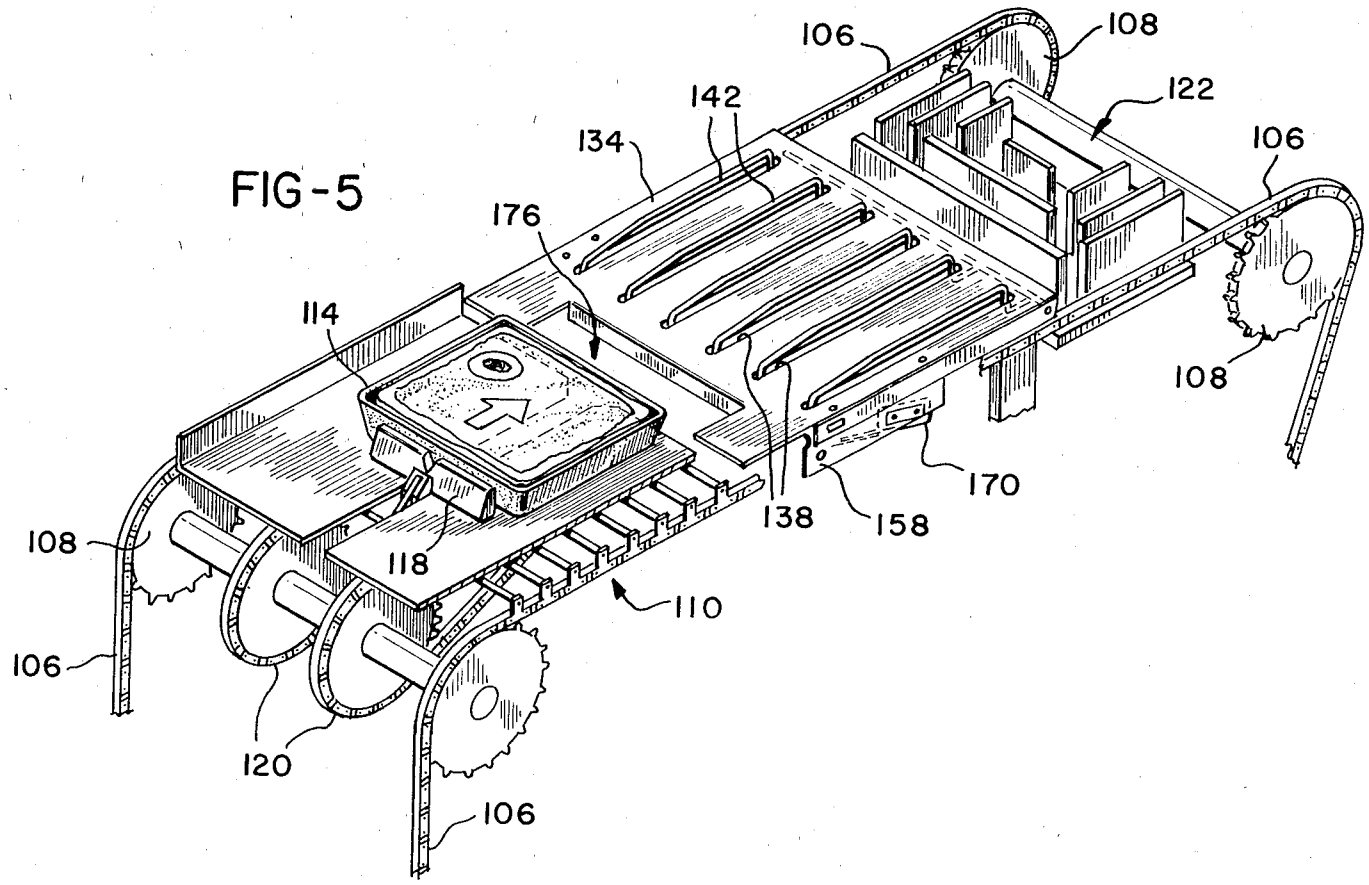
FIG. 5 is a perspective view illustrating the dropped-article sensor shown in FIGS. 1–4.

As best shown in FIGS. 2–5, the preferred embodiment of the dropped-article sensing means 132 comprises a fixedly mounted horizontal plate 134. The plate 134 has side mounting flanges 136 such that it can be secured between the side walls of a package wrapping machine and positioned as best shown in FIGS. 1 and 5. The plate 134 has a plurality of elongated slots 138 formed therethrough as best shown in FIGS. 3 and 5 for receiving a generally horizontal sensing member which, in the case of the preferred embodiment, comprises a grillwork 140 made up of a plurality of slender parallel rods 142 equal in number to the number of the slots 138 through the plate 134 and positioned to pass longitudinally through the slots 138.

The rods 142 are generally L-shaped and include angular extensions 144 for defining an uppermost position of the grillwork 140 by engaging the underside of the plate 134 at one end of the slots 138 which will be referred to herein as the forward end. A stabilizing rod 146 secures the lower ends of the angular extensions 144 to thereby stabilize and maintain the interrod spacing between the rods 142 at the forward end. The opposite ends of the rods 142, referred to herein as the rear ends, have inclined portions 148 leading to short legs 150 of the generally L-shaped rods 142. The outermost rods 142 have additional extensions from their short legs 150 for operating a switch to generate the machine stop or interrupt signal and for resiliently biasing the grillwork 140 to a first upward position as shown in FIGS. 1 and 5.

The short legs 150 of the generally L-shaped rods 142 are secured to a pivot shaft 152 which is in turn mounted for rotation within appropriate bearings 154 formed, for example, from nylon or tetraflurolethylene and secured within end brackets 156 and 158 of the apparatus. The shaft 152 stabilizes and defines the spacing between the rods 142 at the rear ends thereof. As best shown in FIG. 3, collars 160 are secured near the ends of the shaft 152 to maintain its position relative to the end brackets 156 and 158 and thereby maintain the positioning of the rods 142 generally centered within the slots 138.

Due to gravity, the grillwork 140 tends to pivot downwardly about the shaft 152. However, a tension spring 162 extends between a resilient biasing extension 164 of one of the outermost rods 142 and the end bracket 156 as shown in FIG. 4 such that the grillwork 140 is resiliently biased to a first upward position. When the grillwork 140 is in the first upward position, the angular extensions 144 of the rods 142 engage the underside of the plate 134 with the rods 142 of the grillwork 140 extending thereabove.

The opposite outermost rod 142 adjacent to the end bracket 158 includes an extension 166 which angularly extends from its short leg 150 and includes a switch activating member 168 at its distal end as shown in FIGS. 2 and 3. An electrical switch 170 is mounted on the end bracket 158 for generating the wrapping machine stop or interrupt signal in response to movement of the sensing member or grillwork 140 from the first raised position toward a second lowered position defined by the bars 142 being depressed below the upper surface of the plate 134. The switch 170 includes an activating arm 172 which rests against and is controlled by the switch activating member 168 of the grillwork 140. The switch 170 can be adjusted on the end bracket 158 such that its operation is within the following limits: the switch 170 must be deactivated before the grillwork 140 is entirely raised to its first position, and must be activated before any portion of the bars 142 is entirely beneath the upper surface of the plate 134.

The grillwork 140 is moved or deflected either by the weight of a dropped article falling thereon or by the wedging action of an article of insufficient weight being engaged between a platform 110 and the rods 142 of the grillwork 140. It is noted that the inclined portions 148 of the rods 142 facilitate such interference operation of the sensor of the preferred embodiment of the present invention by effectively defining a ramp for articles falling near the rear end of the apparatus. The wrapping machine stop or interrupt signal is passed over wires 174 to the control system of the wrapping machine to thereby interrupt or stop the wrapping machine whenever the sensing means is activated. The stop or interrupt signal may be interpreted by the wrapping machine control system as an open panel which must be closed for operation of the machine or otherwise serve to stop or interrupt the machine as will be apparent to those skilled in the art. With such an arrangement, the wrapping machine can only be restarted by the operator pressing a start button after a dropped article has been removed from the dropped-article sensor 132 which is also preferably cleaned at that time.

The dropped-article sensing means 132 preferably comprises an opening therethrough positioned toward the feed-in station to facilitate cleaning whereby an operator can wipe any debris from the dropped-article sensing means 132 through the opening to maintain the dropped-article sensing means in a sanitary condition. Debris thus cleaned from the dropped-article sensing means either falls to the bottom of the machine or, if the bottom is open, to the floor of the supermarket where it can be conveniently cleaned on a regular basis. As seen in FIGS. 3 and 5, an opening 176 is formed through the rear end of the plate 134 for this purpose.

It is apparent that the dropped-article sensing means 132 of the present invention can be weight triggered by a sufficiently heavy article being dropped thereon. In this regard, it is desirable to set the sensing means as sensitive as possible such that small articles dropped from the article conveyor path can be sensed. The sensitivity of the sensing means must be set to a minimum weight of approximately 0.25 pound. Further, the dropped-article sensing means 132 can be interference triggered if an article does not have sufficient weight to trigger the sensing means.

For the wrapping machine illustrated in FIG. 1 and in the referenced U.S. Pat. No. 4,501,106, packages are conveyed by one of the platforms 110 which pass in close proximity to the upper surface of the dropped article sensing means 132. In one working embodiment, the spacing between the lower surface of the platforms 110 and the upper surface of the rods 142 of the sensing means 132 was approximately $\frac{3}{8}$ inch. If an article too light to weight trigger the dropped-article sensing means 132 falls thereon, the sensing means can be activated when one of the succeeding platforms 110 passes over the dropped article and forces it into one or more of the bars 142. Accordingly, the dropped-article sensing means of the present invention can be both weight activated and interference activated.

Improved apparatus for sensing articles which are dropped from a conveyor path of a package wrapping machine to prevent potential destruction or contamination of the dropped articles, as well as damage to or jamming of the wrapping machine itself has been disclosed above. From this disclosure, a large variety of alternative embodiments will be apparent to those skilled in the art.

Figure 6:
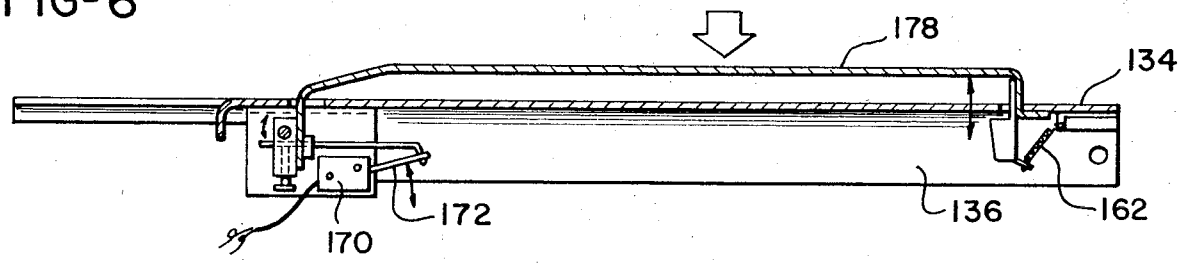
FIGS. 6 and 7 show an alternate embodiment of the dropped-article sensor in accordance with the present invention.
Figure 7:
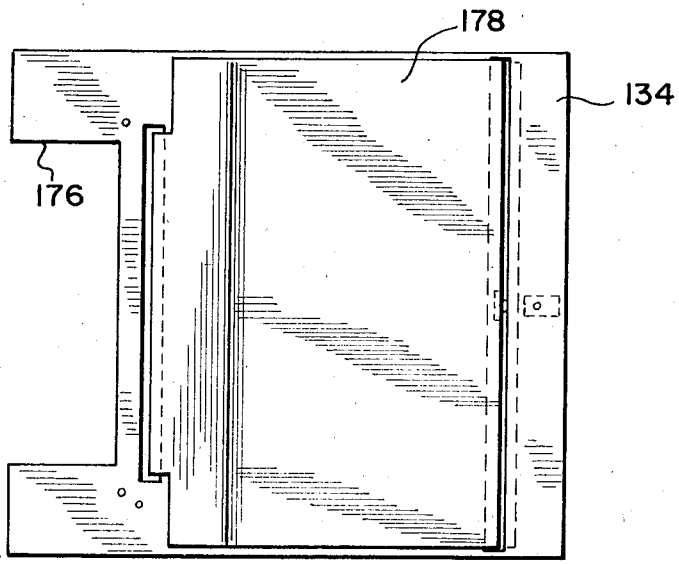

For example, the sensing member may be a generally horizontal plate 178 pivotally mounted at one end as shown in FIGS. 6 and 7. Like elements in FIGS. 6 and 7 are numbered the same in FIGS. 1–5 and will not be further described since their operation is substantially as described previously. Alternative grillworks or plate-like structures may be pivotally or otherwise mounted for resilient movement between a first raised position and a second lowered position, with movement from the first raised position toward the second lowered position signalling a dropped article, and in response thereto, generating a machine stop or interrupt signal.

Alternatively, mechanically movable sensing members may be replaced by a membrane switch panel or the like such that the switch panel both catches a dropped article thereon and generates a machine stop or interrupt signal. Such embodiments provide the potential for increased sensitivity since the reduced mass of the switch panel may be less susceptible to vibration within the package wrapping machine.

Accordingly, while the forms of apparatus herein described constitute preferred embodiments of this invention, it is to be understood that the invention is not limited to these precise forms of apparatus and that changes may be made therein without departing from the scope of the invention which is defined in the appended claims.

What is claimed is:

1. In a wrapping machine including a feed-in station for receiving packages to be wrapped, a wrapping station whereat sheets of wrapping material are wrapped about said packages and conveyor means for conveying said packages along a conveyor path extending between and including said feed-in station and said wrapping station, an improvement comprising dropped-article sensing means positioned beneath said conveyor path between said feed-in station and said wrapping station for catching articles dropped from said conveyor path and for generating a wrapping machine stop signal in response thereto whereby a dropped-article must be retrieved before restarting said wrapping machine and said dropped article may be salvaged.

2. An improvement as claimed in claim 1 wherein said dropped-article sensing means comprises an opening therethrough positioned toward said feed-in station to facilitate cleaning whereby an operator can wipe any debris from said dropped-article sensing means through said opening to maintain said dropped-article sensing means in a sanitary condition.

3. An improvement as claimed in claim 1 wherein said dropped-article sensing means comprises:

a generally horizontal sensing member mounted for movement between a first raised position and a second lowered position;

resilient means connected to said sensing member for biasing said sensing member to said first raised position; and switch means coupled to said sensing member for generating said wrapping machine stop signal in response to movement of said sensing member from said first raised position toward said second lowered position in opposition to said resilient means and in response to a dropped article.

4. An improvement as claimed in claim 3 wherein said sensing member comprises a plate pivotally mounted at one end thereof.

5. An improvement as claimed in claim 4 wherein said resilient means biases said plate such that a force of approximately 0.25 pound is required to operate said sensing member.

6. An improvement as claimed in claim 5 wherein said dropped-article sensing means comprises an opening therethrough positioned toward said feed-in station to facilitate cleaning whereby an operator can wipe any debris from said dropped-article sensing means through said opening to maintain said dropped-article sensing means in a sanitary condition.

7. An improvement as claimed in claim 3 wherein said dropped-article sensing means further comprises a fixedly mounted horizontal plate having a plurality of slots formed therethrough and said generally horizontal sensing member comprises a grillwork including a plurality of parallel rods equal in number to the number of said slots and positioned to pass longitudinally therethrough.

8. An improvement as claimed in claim 7 wherein said grillwork is pivotally mounted at one end thereof.

9. An improvement as claimed in claim 8 wherein said resilient means biases said grillwork such that a force of approximately 0.25 pound is required to operate said sensing member.

10. An improvement as claimed in claim 9 wherein said dropped-article sensing means comprises an opening therethrough positioned toward said feed-in tray to facilitate cleaning whereby an operator can wipe any debris from said dropped-article sensing means through said opening to maintain said dropped-article sensing means in a sanitary condition.

11. An improvement as claimed in claim 1 wherein said conveyor means passes in close proximity over said dropped-article sensing means such that said dropped-article sensing means can be activated by the weight of a dropped article or by interference between a dropped article and said conveyor means.

12. An improvement as claimed in claim 11 wherein said conveyor means comprises a number of platforms intermittently passing in close proximity over said dropped-article sensing means such that said dropped-article sensing means can be activated by the weight of a dropped article and one of said platforms.

13. In a package elevating wrapping machine including a feed-in station for receiving packages to be wrapped, a wrapping station whereat packages are received upon an elevator and in turn elevated into sheets of wrapping material which are wrapped about said packages and a conveyor formed by a series of continuously circulating platforms for conveying said packages from said feed-in station to said wrapping station along a conveyor path defined by the circulation of said platforms which are spaced apart to permit elevation of said elevator, an improvement comprising dropped-article sensing means positioned beneath said conveyor path between said feed-in station and said wrapping station for catching articles dropped from said conveyor path between said platforms and for generating a wrapping machine stop signal in response thereto whereby a dropped-article must be retrieved before restarting said wrapping machine and said dropped article may be salvaged.

14. An improvement ed as claimed in claim 13 wherein said dropped-article sensing means comprises:

a generally horizontal sensing member mounted for movement between a first raised position and a second lowered position;

resilient means connected to said sensing member for biasing said sensing member to said first raised position; and switch means coupled to said sensing member for generating said wrapping machine stop signal in response to movement of said sensing member from said first raised position toward said second lowered position in opposition to said resilient means and in response to a dropped article.

15. An improvement as claimed in claim 14 wherein said sensing member comprises a plate pivotally mounted at one end thereof.

16. An improvement as claimed in claim 14 wherein said dropped-article sensing means further comprises a fixedly mounted horizontal plate having a plurality of slots formed therethrough and said generally horizontal sensing member comprises a grillwork including a plurality of parallel rods equal in number to the number of said slots and positioned to pass longitudinally therethrough.

17. An improvement as claimed in claim 16 wherein said grillwork is pivotally mounted at one end thereof.

18. An improvement as claimed in claim 17 wherein said resilient means biases said grillwork such that a force of approximately 0.25 pound is required to operate said sensing member.

19. An improvement as claimed in claim 18 wherein said dropped-article sensing means comprises an opening therethrough positioned toward said feed-in tray to facilitate cleaning whereby an operator can wipe any debris from said dropped-article sensing means through said opening to maintain said dropped-article sensing means in a sanitary condition.

20. An improvement as claimed in claim 13 wherein said platforms pass in close proximity over said dropped-article sensing means such that said dropped-article sensing means can be activated by the weight of a dropped article or by interference between a dropped article and one of said platforms.

* * * * *